US006903601B1

(12) United States Patent
Aude

(10) Patent No.: US 6,903,601 B1
(45) Date of Patent: Jun. 7, 2005

(54) REFERENCE VOLTAGE GENERATOR FOR BIASING A MOSFET WITH A CONSTANT RATIO OF TRANSCONDUCTANCE AND DRAIN CURRENT

(75) Inventor: Arlo Aude, Atlanta, GA (US)

(73) Assignee: National Semiconductor Corporation, Santa Clara, CA (US)

( * ) Notice: Subject to any disclaimer, the term of this patent is extended or adjusted under 35 U.S.C. 154(b) by 137 days.

(21) Appl. No.: 10/641,247

(22) Filed: Aug. 14, 2003

(51) Int. Cl.[7] ..... G05F 3/02; G05F 3/16

(52) U.S. Cl. ..... 327/541; 327/538; 323/313; 323/315

(58) Field of Search ..... 327/530, 552, 327/543, 538, 541, 546, 276, 287, 539; 323/312, 315, 316

(56) References Cited

U.S. PATENT DOCUMENTS 4,583,037 A 4/1986 Sooch
4,808,847 A * 2/1989 Van Kessel ..... 327/108
5,198,782 A * 3/1993 Scott ..... 330/277
5,892,356 A * 4/1999 Chuang ..... 323/315
5,929,699 A 7/1999 Lewicki
6,069,520 A * 5/2000 Yamamoto et al. ..... 327/538
6,160,432 A * 12/2000 Rhee et al. ..... 327/157

* cited by examiner

*Primary Examiner*—Rajnikant B. Patel
(74) *Attorney, Agent, or Firm*—Vedder Price Kaufman & Kammholz, P.C.

(57) ABSTRACT

An integrated circuit (IC) with metal oxide semiconductor field effect transistor (MOSFET) circular for generating a reference signal having a value which remains substantially constant over variations in one or more of the processing (P) of, power supply voltage (V) for and operating temperature (T) of the IC, with such reference signal being suitable for use in generating one or more biasing signals for one or more MOSFETs such that each MOSFET so biased will have a substantially constant ratio of transconductance and drain current.

20 Claims, 4 Drawing Sheets

REFERENCE VOLTAGE GENERATOR FOR BIASING A MOSFET WITH A CONSTANT RATIO OF TRANSCONDUCTANCE AND DRAIN CURRENT

BACKGROUND OF THE INVENTION

1. Field of the Invention

The present invention relates to integrated circuits employing metal oxide semiconductor field effect transistor (MOSFET) circuitry, in and particular, to ICs employing MOSFET circuitry having internal compensation for variations among the processing (P) of, power supply voltage (V) for, and operating temperature (T) of the IC (otherwise known as PVT).

2. Description of the Related Art

As is well-known, IC densities have been increasing as generations of IC fabrication processes have become more sophisticated. Increases in density are achieved primarily by reducing the sizes, e.g., channel lengths and widths, of the MOSFETs. With such decreases in dimensions, power supply voltages have also decreased. One benefit of this is generally lower power dissipation. However, power supply voltages have become so low that inherent operating characteristics of the transistors have become limiting factors in performance of the circuits. For example, one such limiting factor in analog circuits employing MOSFETs is the drain-to-source voltage VDS of the MOSFET devices when operated in the generally desired state of saturation. This output saturation voltage VDSAT, as is well-known, is the minimum voltage required between the drain and source terminals for the transistor to remain operating in its saturation region.

Conventional techniques for attempting to maintain some consistency in operating parameters include biasing selected portions of the circuitry to either maintain a constant transconductance (gm) or a constant drain current (id). However, as illustrated by equations 1–3below (where K' equals the product of the majority carrier mobility u and the gate capacitance per unit area Cox), maintaining a fixed transconductance or fixed drain current results in a variable output saturation voltage VDSAT.

Equation 1:

$$id = \frac{K'W}{2L}(Vgs - Vt)^2$$

Equation 2:

$$gm = \frac{\delta id}{\delta Vgs} = \frac{K'W}{L}(Vgs - Vt) = \frac{2id}{VDSAT}$$

Equation 3:

$$\frac{gm}{id} = \frac{2}{VDSAT}$$

In many instances, variations in PVT can cause the output saturation voltage VDSAT to change by a factor of 2–3 when either the transconductance or drain current is fixed. Accordingly, these techniques are inadequate for low voltage circuits where the output saturation voltage VDSAT directly determines the output voltage range, and, therefore, the dynamic output signal range, that an amplifier may have. A typical example would be a simple N-type MOSFET output stage with a P-type MOSFET load. Such an amplifier will have an output dynamic signal range approximately equal to the difference between the power supply voltage and two output saturation voltages, i.e., VDD−2*VDSAT. Assuming that the MOSFETs are designed with a nominal output saturation voltage VDSAT of 150 millivolts and the power supply voltage VDD is 1.0 volt, such amplifier will have a nominal output dynamic signal range of 0.7 volt (=1.0−*0.15). However, if the output saturation voltage VDSAT varies by a factor of three, a dynamic output signal voltage range will decrease to only 0.1 volt (=1.0−3*2*0.15).

SUMMARY OF THE INVENTION

In accordance with the presently claimed invention, an integrated circuit (IC) includes metal oxide semiconductor field effect transistor (MOSFET) circuitry for generating a reference signal having a value which remains substantially constant over variations in one or more of the processing (P) of, power supply voltage (V) for and operating temperature (T) of the IC, with such reference signal being suitable for use in generating one or more biasing signals for one or more MOSFETs such that each MOSFET so biased will have a substantially constant ratio of transconductance and drain current.

In accordance with one embodiment of the presently claimed invention, an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of the IC includes current source circuitry, reference resistance circuitry, reference MOSFETs and current mirror circuitry. The current source circuitry provides at least one reference current having a current value 1. The reference resistance circuitry has a resistance value R, includes first and second terminals, is coupled to the current source circuitry and is responsive to reception of the at least one reference current by providing a first reference voltage at the first reference resistance circuitry terminal. A first reference MOSFET having a channel width dimension is coupled to the first reference resistance circuitry terminal and is responsive to reception of the first reference voltage by conducting a first mirrored current and providing a bias voltage. The current mirror circuitry is coupled to the first reference MOSFET and is responsive to reception of the bias voltage by providing the first mirrored current and a second mirrored current. A second reference MOSFET having a channel width dimension approximately equal to 1/N2 of the first reference MOSFET channel width dimension is coupled to the current mirror circuitry and the second reference resistance circuitry terminal, and is responsive to reception of the second mirrored current by providing a second reference voltage at the second reference resistance circuitry terminal, wherein N is an integer greater than unity and a voltage difference between the first and second reference voltages remains substantially constant over PVT variations.

In accordance with another embodiment of the presently claimed invention, an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of the IC includes current source means, reference resistance means, reference MOSFETs and current mirror means. The current source means is for generating at least one reference current. The reference resistance means is for receiving the at least one reference current and in response thereto generating a first reference voltage. A first reference MOSFET having a channel width dimension is responsive to reception of the first reference voltage by conducting a first mirrored current and providing a bias voltage. The current mirror means is for receiving the bias voltage and in response thereto generating the first mirrored current and a second mirrored current A second reference MOSFET having a channel width dimension approximately equal to 1/N2 of the first reference MOSFET channel width dimension is responsive to reception of the second mirrored current by providing a second reference voltage, wherein N is an integer greater than unity and a voltage difference between the first and second reference voltages remains substantially constant over PVT variations.

In accordance with another embodiment of the presently claimed invention, an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of the IC includes current source circuitry, reference resistance circuitry, reference MOSFETs, current mirror circuitry and amplifier circuitry. The current source circuitry provides at least one reference current having a current value 1. The reference resistance circuitry has a resistance value R, includes first and second terminals, is coupled to the current source circuitry and is responsive to reception of the at least one reference current by providing first and second reference voltages at the first and second reference resistance circuitry terminals, respectively. A first reference MOSFET having a channel width dimension is coupled to the first reference resistance circuitry terminal and is responsive to reception of the first reference voltage by conducting a first mirrored current and providing a first bias voltage. The current mirror circuitry is coupled to the first reference MOSFET and is responsive to reception of the first bias voltage by providing the first mirrored current and a second mirrored current. A second reference MOSFET having a channel width dimension approximately equal to 1/N2 of the first reference MOSFET channel width dimension is coupled to the current mirror circuitry and is responsive to reception of the second mirrored current by providing a third reference voltage, wherein N is an integer greater than unity. The amplifier circuitry includes a first input terminal coupled to the second reference resistance circuitry terminal, a second input terminal coupled to the second reference MOSFET and an output terminal coupled to the first reference resistance circuitry terminal, and is responsive to reception of the second and third reference voltages by maintaining the first reference voltage such that a voltage difference between the first and second reference voltages remains substantially constant over PVT variations.

In accordance with another embodiment of the presently claimed invention, an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of the IC includes current source means, reference resistance means, reference MOSFETs, current mirror means and amplifier means. The current source means is for generating at least one reference current. The reference resistance means is for receiving the at least one reference current and in response thereto generating a first reference voltage. A first reference MOSFET having a channel width dimension is responsive to reception of the first reference voltage by conducting a first mirrored current and providing a bias voltage. The current mirror means is for receiving the bias voltage and in response thereto generating the first mirrored current and a second mirrored current. A second reference MOSFET having a channel width dimension approximately equal to 1/N2 of the first reference MOSFET channel width dimension is responsive to reception of the second mirrored current by providing a third reference voltage, wherein N is an integer greater than unity. The amplifier means is for receiving the second and third reference voltages and in response thereto maintaining the first reference voltage such that a voltage difference between the first and second reference voltages remains substantially constant over PVT variations.

DETAILED DESCRIPTION OF THE INVENTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

It will be appreciated and understood by one of ordinary skill in the art that MOSFET circuitry in accordance with the presently claimed invention can be implemented with a P-MOSFET current mirror circuit and N-MOSFET biasing circuitry as discussed herein, or alternatively, with an N-MOSFET current mirror circuit and P-MOSFET biasing circuitry with appropriate reversals in drain and source terminal connections and power supply voltage polarity in accordance with well known conventional circuit design techniques.

Figure 1:
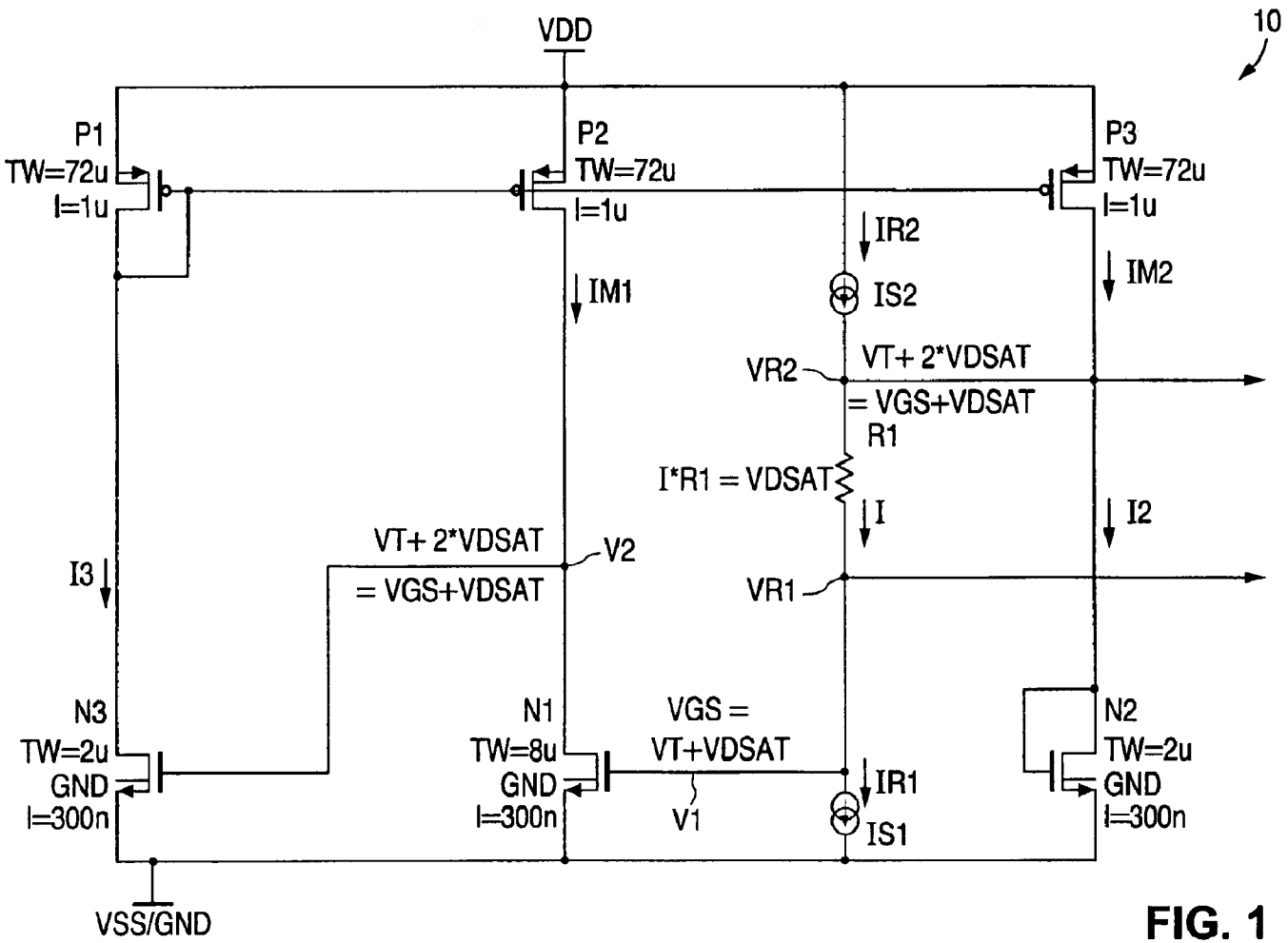
FIG. 1 is a circuit schematic diagram of MOSFET circuitry in accordance with one embodiment of the presently claimed invention.

Referring to FIG. 1, MOSFET circuitry 10 for generating one or more reference signals suitable for use in maintaining a constant ratio of transconductance and drain current for MOSFETs includes N-type MOSFETs N1, N2 and N3, P-type MOSFETs P1, P2 and P3, reference current sources IS1 and IS2, and a reference resistance R1 (having a resistance value R1), all interconnected substantially as shown between the positive VDD and negative VSS/GND power supply terminals. As indicated in the schematic, in this example embodiment 10, transistors N1, N2 and N3 have channel lengths of 300 nanometers (or 0.3 microns), transistor N1 has a channel width of 8 microns, transistors N2 and N3 have channel widths of 2 microns, and transistors P1, P2 and P3 have channel lengths of 1 micron and channel widths of 72 microns.

In accordance with a well-known circuit design technique (e.g., see U.S. Pat. No. 4,583,037, the disclosure of which is incorporated herein by reference), the dimensions of transistor N2 are scaled in proportion to the corresponding dimensions of transistor N1, and in particular, the channel width of transistor N2 is designed to be one-fourth of the channel width of transistor N1. Accordingly the gate-to-source voltage VGS of transistor N2 is maintained as equal to the sum of the gate-to-source voltage VGS of transistor N1 plus the drain-to-source saturation voltage VDSAT of transistor N2.

This can be demonstrated in accordance with well-known MOSFET circuit operating characteristics. As is well-known, drain currents ID1 and ID2 of transistors N1 and N2, respectively, can be computed based upon the majority carrier mobility u, the gate capacitance per unit area Cox, the channel width W, channel length L, threshold voltage VT, transistor scaling factor N, and the respective gate-to-source voltages VGS1 (transistor N1), VGS2 (transistor N2) as follows:

Equation 4:

$$id_1 = \frac{u \cdot Cox}{2} \cdot \frac{N \cdot W}{L}(VGS_1 - VT)^2$$

Equation 5:

$$id_2 = \frac{u \cdot Cox}{2} \cdot \frac{W}{L}(VGS_2 - VT)^2$$

Setting these currents equal to each other ($id_1 = id_2$) produces Equation 6, which can be simplified and reduced as follows, for scaling factors of N=4 and N=9:

Equation 6:

$$\frac{u \cdot Cox}{2} \cdot \frac{N \cdot W}{L}(VGS_1 - VT)^2 = \frac{u \cdot Cox}{2} \cdot \frac{W}{L}(VGS_2 - VT)^2$$

$$N(VGS_1-VT)^2=(VGS_2-VT)^2 \quad \text{Equation 7}$$

$$\sqrt{N}(VGS_1-VT)=(VGS_2-VT) \quad \text{Equation 8}$$

$$VGS_2=\sqrt{N}(VGS_1-VT)+VT \quad \text{Equation 9}$$

$$VGS_2-VGS_1=\sqrt{N}(VGS_1-VT)+VT-VGS_1 \quad \text{Equation 10}$$

$$VGS_2-VGS_1=\sqrt{N}(VGS_1-VT)-(VGS_1-VT) \quad \text{Equation 11}$$

$$VGS_2-VGS_1=(\sqrt{N}-1)(VGS_1-VT) \quad \text{Equation 12}$$

$$\text{Example: } N=4, VGS_2-VGS_1=(VGS_1-VT)=VDSAT_1 \quad \text{Equation 13}$$

$$\text{Example: } N=9, VGS_2-VGS_1=2(VGS_1-VT)=2VDSAT_1 \quad \text{Equation 14}$$

Reference current sources IS1 and IS2 (discussed in more detail below) provide reference currents IR1 and IR2, respectively, with such reference currents IR1, IR2 ideally being equal. As noted above, the gate terminal voltage V1 of transistor N1 causes transistor N1 to provide a bias voltage V2 to the gate terminal of transistor N3, thereby establishing an input current I3 for the current mirror circuitry formed by transistors P1, P2 and P3. This input current I3 is replicated, or mirrored, as output mirror currents IM1 and IM2 by transistors P1 and P3, respectively.

The reference current IR1, IR2 provided by the reference current sources IS1, IS2 are ideally equal to each other and provide the current I through reference resistance R1. In conformance with the discussion above, the first reference voltage VR1 is equal to the gate-to-source voltage VGS for transistor N1 (and, therefore, equal to the sum of its threshold voltage VT and output saturation voltage VDSAT of transistor N1) while the second reference voltage VR2 at the mutually coupled drain and gate terminals of transistor N2 is equal to the sum of such gate-to-source voltage VGS and output saturation voltage VDSAT. Accordingly, the voltage difference across reference resistance R1 is one output saturation voltage VDSAT potential and is equal to the product of the current I and resistance value R1.

Unfortunately, due to the direct connection of reference transistor N2 to the reference current I path through reference resistance R1, some current shunting may occur. Ideally, as noted above, reference currents IR1 and IR2 are equal and together produce the current I through resistor R1. The second current mirror output current IM2 would also equal the current I2 through transistor N2. However, due to small imbalances or imperfections which may be expected in the circuitry 10, these current relationships may not hold true. For example, some of the second reference current IR2 or current mirror output current IM2 may be shunted through reference resistor R1 or reference transistor N2, respectively.

Figure 2:
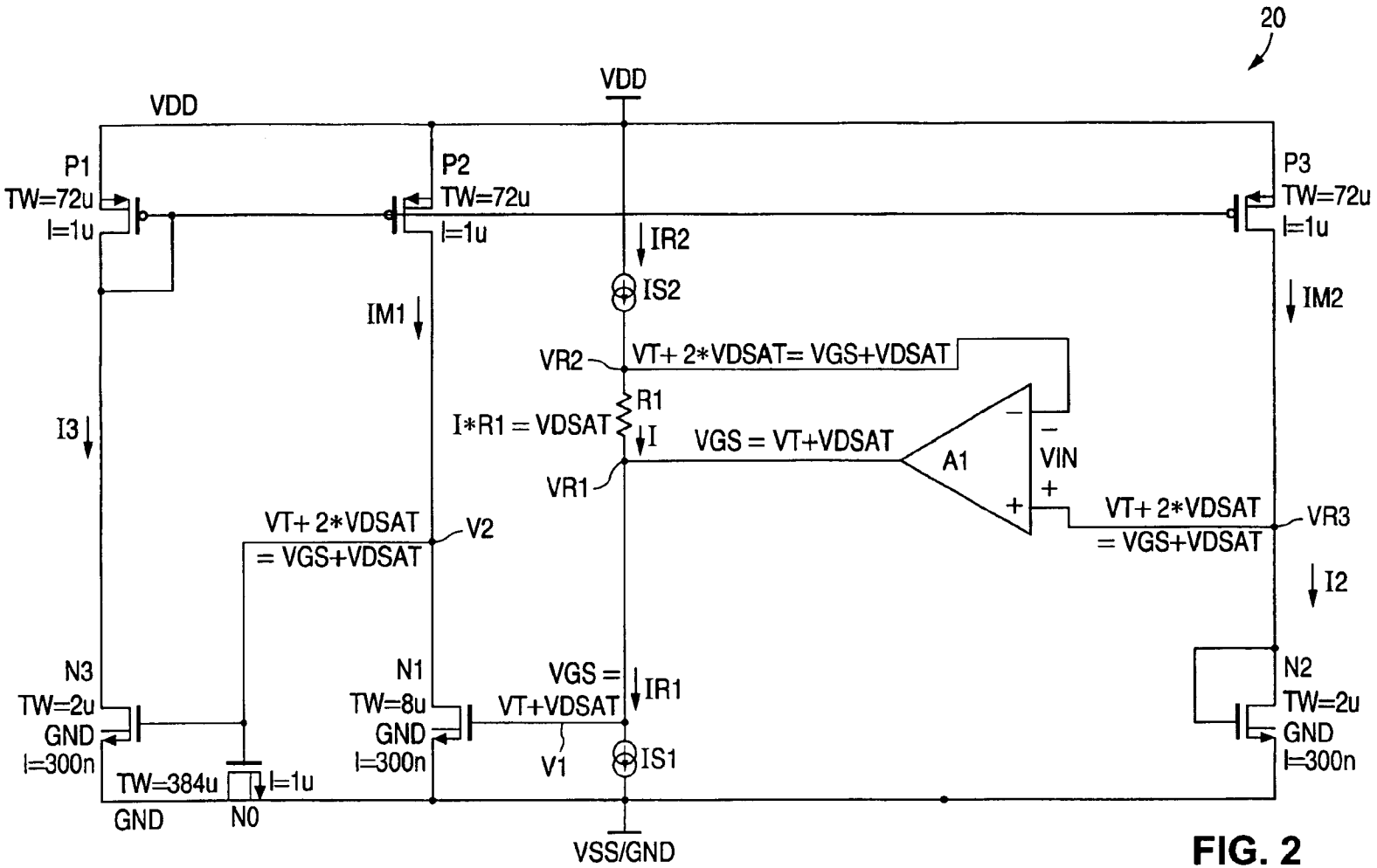
FIG. 2 is a circuit schematic diagram of MOSFET circuitry in accordance with another embodiment of the presently claimed invention.

Referring to FIG. 2, a circuit 20 in accordance with another embodiment of the presently claimed invention introduces a buffer amplifier A1 between the circuit branches containing reference transistor N2 and reference resistor R1, substantially as shown. (Transistor N0 forms a capacitor with its drain and source terminals connected to provide a compensation capacitance at the gate terminal of transistor N3 for purposes of maintaining circuit stability.) This amplifier A1 (e.g., a differential amplifier) receives, via its non-inverting input terminal, the reference voltage VR3 at the drain and gate terminals of transistor N2, and receives, via its inverting input terminal, the reference voltage VR2 between the second reference current source IS2 and the reference resistor R1. Hence, this amplifier A1 will force its output at the reference voltage VR1 between the first reference current source IR1 and the reference resistor R1 to be equal to that value necessary to maintain its input voltage VIN at a substantially zero value. In other words, the reference voltage VR3 established by transistor N2, in conformance with the discussion above concerning the relative scaling of reference transistors N1 and N2, will cause the output voltage of amplifier A1 to be such that the other reference voltage VR2 will be equal to the reference voltage VR3 across transistor N2, thereby causing the difference voltage across resistor R1 to be equal to the desired MOSFET output saturation voltage VDSAT, as discussed above.

Figure 3:
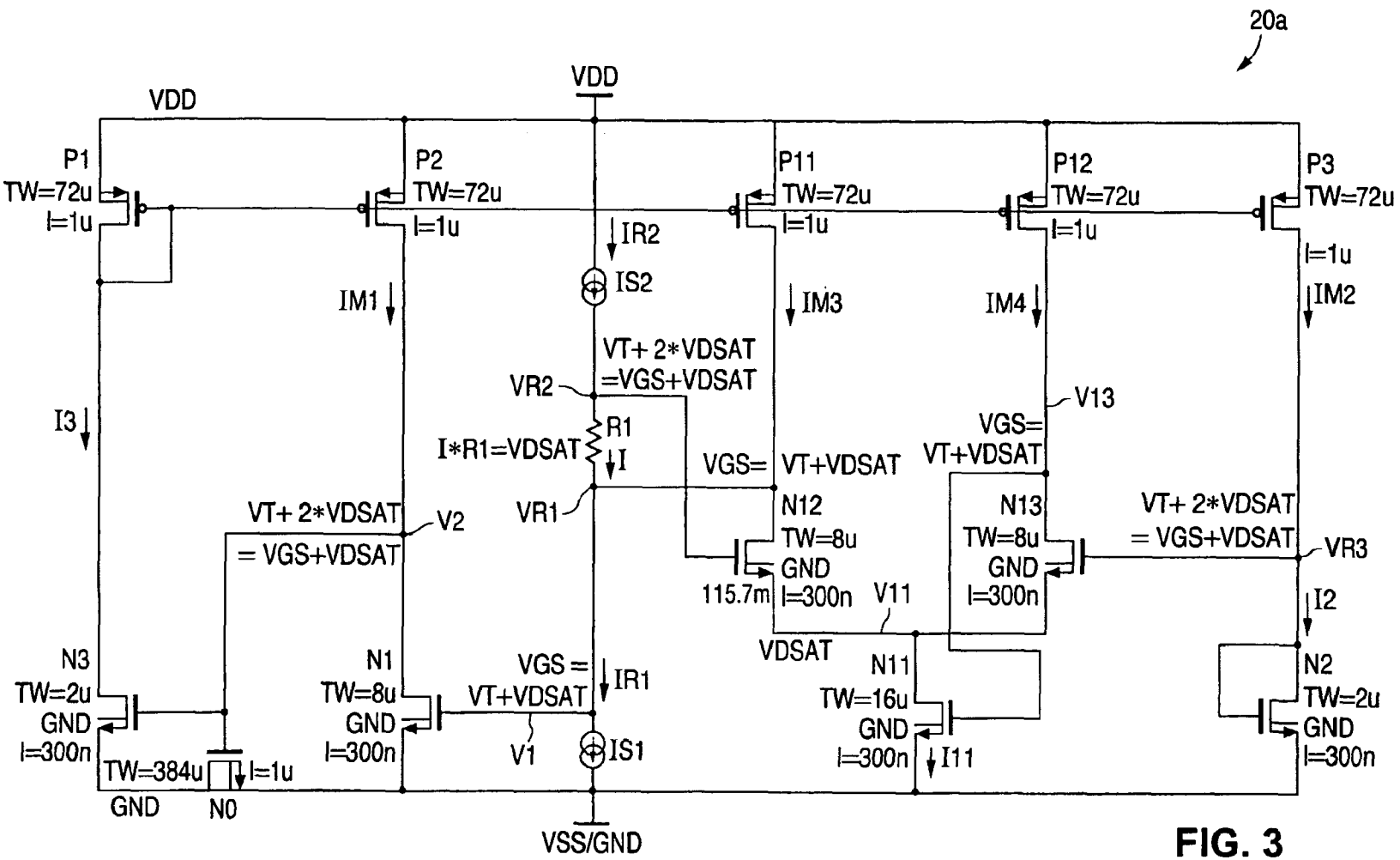
FIG. 3 is a circuit schematic diagram of MOSFET circuitry in accordance with another embodiment of the presently claimed invention.

Referring to FIG. 3, an alternative circuit 20*a* in accordance with another embodiment of the presently claimed invention implements the buffer amplifier A1 using N-MOSFETS N11, N12 and N13 and P-MOSFETs P11 and P12, interconnected substantially as shown. Transistor N11 has a channel width equal to the sum of the equal channel widths of transistors N12 and N13, while transistors P11 and P12 have channel dimensions corresponding to those of the other current mirror transistors P1, P2 and P3. Accordingly, current mirror output currents IM3 and IM4 are generated by transistors P11 and P12, respectively. These currents IM3, IM4 are conducted by transistors N12 and N13 and summed for conduction as current I11 through transistor N11. Accordingly, since current I11 through transistor N11 is two times the value of the current IM1 through transistor N1 and transistor N11 has a channel width two times the channel width of transistor N1, then the gate-to-source voltage VGS of transistor N11, i.e., voltage V13 at the gate terminal, is equal to the gate terminal voltage V1 (VR1) of transistor N1. Transistor N11 is operated in saturation; therefore, voltage V11 at its drain terminal is a MOSFET output saturation voltage VDSAT potential.

This circuit 20*a* is self-biasing and does not degrade the minimum required power supply voltage VDD−VSS/GND. Accordingly, this circuit 20*a* is fully operational down to a power supply voltage VDD−VSS/GND equal to the sum of the threshold voltage and three times the output saturation voltage, i.e., VT+3*VDSAT.

As should be evident from an inspection of the circuits of FIGS. 1 and 3, both circuits 10, 20*a* have both positive and negative feedback loops. Transistors N1, N2 and N3 are scaled so as to cause the channel width of transistor N1 to be larger than the channel widths of transistors N2 and N3, thereby ensuring that the negative feedback loop has more gain than the positive feedback loop to maintain circuit stability.

Figure 4:
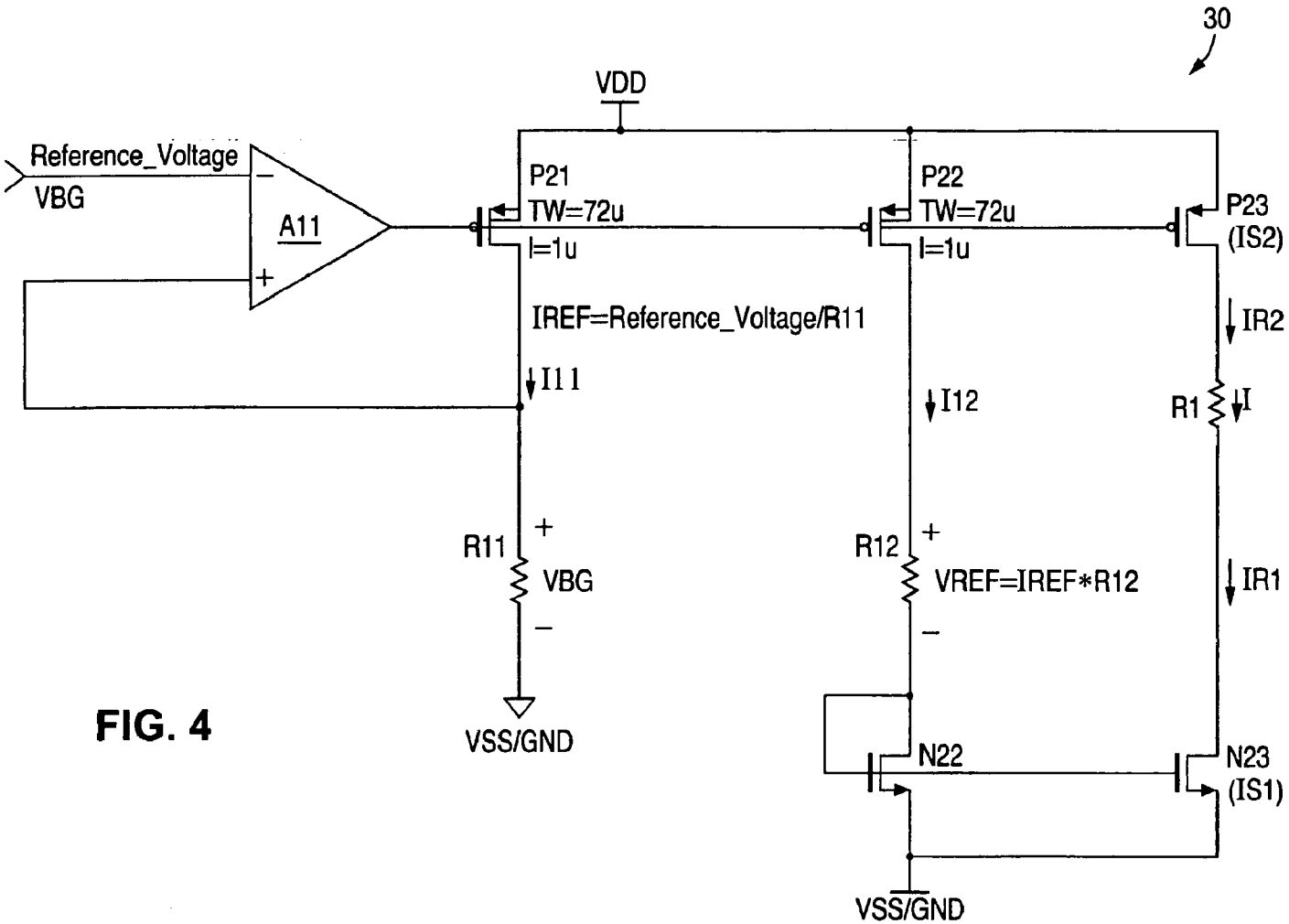
FIG. 4 is a circuit schematic diagram for one example of current source circuitry suitable for use in the circuits of FIGS. 1, 2 and 3 for generating the reference currents.

Referring to FIG. 4, the reference currents IR1, IR2 can be generated and provided to the reference resistor R1 using a circuit 30 similar to that as shown. A stable reference voltage, e.g., such as a bandgap reference voltage VBG as provided by a bandgap reference voltage generator (many of which are well-known in the art), is buffered by an amplifier A11 (e.g., an operational amplifier) and drives P-MOSFETs P21, P22 and P23 as shown. Accordingly, the input reference voltage VBG appears across resistor R11, thereby establishing the reference current I11(=IREF) through transistor P21. This reference current I11 is mirrored by transistors P22 and P23, with transistor P23 serving as the second reference current source IS2 and the mirrored output current being the second reference current IR2. The first mirrored reference current I12(=IREF) is also conducted through another reference resistor R12 and a diode-connected N-MOSFET N22 which serves as the input transistor to a current mirror formed by transistors N22 and N23, with transistor N23 serving as the first reference current source IS1 to provide the first reference current IR1.

In a preferred embodiment, resistors R1, R11 and R12 are integrated within the same IC and are proportional in their respective resistance values. If equal reference currents I11, I12, IR2 are desired, then the resistance values R1, R11, R12 will also be equal. Other proportions are possible, however, by appropriate scaling of the transistors P21, P22, P23, N22, N23 in accordance with well-known current mirror design techniques.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of said IC, comprising:

current source circuitry to provide at least one reference current having a current value I;

first reference resistance circuitry having a first resistance value R1, including first and second terminals, coupled to said current source circuitry and responsive to reception of said at least one reference current by providing a first reference voltage at said first reference resistance circuitry terminal;

a first reference MOSFET having a channel width dimension, coupled to said first reference resistance circuitry terminal and responsive to reception of said first reference voltage by conducting a first mirrored current and providing a first bias voltage;

current mirror circuitry coupled to said first reference MOSFET and responsive to reception of said first bias voltage by providing said first mirrored current and a second mirrored current; and a second reference MOSFET having a channel width dimension approximately equal to 1/N2 of said first reference MOSFET channel width dimension, coupled to said current mirror circuitry and said second reference resistance circuitry terminal, and responsive to reception of said second mirrored current by providing a second reference voltage at said second reference resistance circuitry terminal, wherein N is an integer greater than unity and a voltage difference between said first and second reference voltages remains substantially constant over PVT variations.

2. The apparatus of claim 1, wherein:

said at least one reference current comprises a plurality of reference currents;

said current source circuitry comprises a first current source circuit coupled to said first reference resistance circuitry terminal to provide a first one of said plurality of reference currents, and a second current source circuit coupled to said second reference resistance circuitry terminal to provide a second one of said plurality of reference currents; and said first and second reference currents are substantially equal.

3. The apparatus of claim 1, wherein said current source circuitry comprises:

reference voltage circuitry to provide a reference voltage; and second reference resistance circuitry having a second resistance value R2 substantially equal to said first resistance value R1, coupled to said reference voltage circuitry and responsive to said reference voltage by conducting said at least one reference current.

4. The apparatus of claim 1, wherein said current mirror circuitry comprises a scaled MOSFET having a channel width dimension approximately equal to 1/N2 of said first reference MOSFET channel width dimension, coupled to said first reference MOSFET and responsive to reception of said first bias voltage by conducting a drive current proportional to said first and second mirrored currents.

5. The apparatus of claim 4, wherein said current mirror circuitry further comprises:

an input MOSFET with mutually coupled gate and drain terminals, coupled to said scaled MOSFET and responsive to said drive current by providing a second bias voltage; and first and second output MOSFETs coupled to said input MOSFET and responsive to said second bias voltage by providing said first and second mirrored currents.

6. The apparatus of claim 1, wherein said second reference MOSFET has mutually coupled gate and drain terminals.

7. The apparatus of claim 1, wherein N=2 and said voltage difference comprises a MOSFET output saturation voltage.

8. The apparatus of claim 1, wherein said current value I and said first resistance value R1 vary with said PVT variations in a mutually inverse proportional relationship such that a product I*R1 of said current value I and said first resistance value R1 is substantially constant over said PVT variations.

9. An apparatus including an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of said IC, comprising:

current source means for generating at least one reference current;

reference resistance means for receiving said at least one reference current and in response thereto generating a first reference voltage;

a first reference MOSFET having a channel width dimension and responsive to reception of said first reference voltage by conducting a first mirrored current and providing a bias voltage;

current mirror means for receiving said bias voltage and in response thereto generating said first mirrored current and a second mirrored current; and a second reference MOSFET having a channel width dimension approximately equal to 1/N2 of said first reference MOSFET channel width dimension and responsive to reception of said second mirrored current by providing a second reference voltage, wherein N is an integer greater than unity and a voltage difference between said first and second reference voltages remains substantially constant over PVT variations.

10. An apparatus including an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of said IC, comprising:

current source circuitry to provide at least one reference current having a current value I;

first reference resistance circuitry having a first resistance value R1, including first and second terminals, coupled to said current source circuitry and responsive to reception of said at least one reference current by providing first and second reference voltages at said first and second reference resistance circuitry terminals, respectively;

a first reference MOSFET having a channel width dimension, coupled to said first reference resistance circuitry terminal and responsive to reception of said first reference voltage by conducting a first mirrored current and providing a first bias voltage;

current mirror circuitry coupled to said first reference MOSFET and responsive to reception of said first bias voltage by providing said first mirrored current and a second mirrored current;

a second reference MOSFET having a channel width dimension approximately equal to 1/N2 of said first reference MOSFET channel width dimension, coupled to said current mirror circuitry and responsive to reception of said second mirrored current by providing a third reference voltage, wherein N is an integer greater than unity; and amplifier circuitry including a first input terminal coupled to said second reference resistance circuitry terminal, a second input terminal coupled to said second reference MOSFET and an output terminal coupled to said first reference resistance circuitry terminal, and responsive to reception of said second and third reference voltages by maintaining said first reference voltage such that a voltage difference between said first and second reference voltages remains substantially constant over PVT variations.

11. The apparatus of claim 10, wherein:

said at least one reference current comprises a plurality of reference currents;

said current source circuitry comprises a first current source circuit coupled to said first reference resistance circuitry terminal to provide a first one of said plurality of reference currents, and a second current source circuit coupled to said second reference resistance circuitry terminal to provide a second one of said plurality of reference currents; and said first and second reference currents are substantially equal.

12. The apparatus of claim 10, wherein said current source circuitry comprises:

reference voltage circuitry to provide a reference voltage; and second reference resistance circuitry having a second resistance value R2 substantially equal to said first resistance value R1, coupled to said reference voltage circuitry and responsive to said reference voltage by conducting said at least one reference current.

13. The apparatus of claim 10, wherein said current mirror circuitry comprises a scaled MOSFET having a channel width dimension approximately equal to 1/N2 of said first reference MOSFET channel width dimension, coupled to said first reference MOSFET and responsive to reception of said first bias voltage by conducting a drive current proportional to said first and second mirrored currents.

14. The apparatus of claim 13, wherein said current mirror circuitry further comprises:

an input MOSFET with mutually coupled gate and drain terminals, coupled to said scaled MOSFET and responsive to said drive current by providing a second bias voltage; and first and second output MOSFETs coupled to said input MOSFET and responsive to said second bias voltage by providing said first and second mirrored currents.

15. The apparatus of claim 10, wherein said second reference MOSFET has mutually coupled gate and drain terminals.

16. The apparatus of claim 10, wherein N=2 and said voltage difference comprises a MOSFET output saturation voltage.

17. The apparatus of claim 10, wherein said current value I and said first resistance value R1 vary with said PVT variations in a mutually inverse proportional relationship such that a product I*R1 of said current value I and said first resistance value R1 is substantially constant over said PVT variations.

18. The apparatus of claim 10, wherein said amplifier circuitry comprises differential amplifier circuitry including a first input terminal coupled to said second reference resistance circuitry terminal, a second input terminal coupled to said second reference MOSFET and an output terminal coupled to said first reference resistance circuitry terminal.

19. The apparatus of claim 18, wherein:

said current mirror circuitry is further responsive to reception of said first bias voltage by providing third and fourth mirrored currents;

said differential amplifier circuitry is further coupled to said current mirror circuitry and is further responsive to reception of said third and fourth mirrored currents and said second and third reference voltages by maintaining said first reference voltage such that said voltage difference between said first and second reference voltages remains substantially constant over said PVT variations.

20. An apparatus including an integrated circuit (IC) with metal oxide semiconductor field effect transistor (MOSFET) circuitry for generating a reference signal having a value which remains substantially constant over variations in one or more of the processing (P) of, power supply voltage (V) for and operating temperature (T) of said IC, comprising:

current source means for generating at least one reference current;

reference resistance means for receiving said at least one reference current and in response thereto generating a first reference voltage;

a first reference MOSFET having a channel width dimension and responsive to reception of said first reference voltage by conducting a first mirrored current and providing a bias voltage;

current mirror means for receiving said bias voltage and in response thereto generating said first mirrored current and a second mirrored current;

a second reference MOSFET having a channel width dimension approximately equal to 1/N2 of said first reference MOSFET channel width dimension and responsive to reception of said second mirrored current by providing a third reference voltage, wherein N is an integer greater than unity; and amplifier means for receiving said second and third reference voltages and in response thereto maintaining said first reference voltage such that a voltage difference between said first and second reference voltages remains substantially constant over PVT variations.

* * * * *